US010066634B2

(12) United States Patent
Ogata et al.

(10) Patent No.: US 10,066,634 B2
(45) Date of Patent: Sep. 4, 2018

(54) TURBO MACHINE

(71) Applicant: Panasonic Intellectual Property Management Co., Ltd., Osaka (JP)

(72) Inventors: Takeshi Ogata, Osaka (JP); Tadayoshi Shoyama, Osaka (JP); Akira Hiwata, Shiga (JP); Hidetoshi Taguchi, Osaka (JP); Kazuyuki Kouda, Osaka (JP); Hiroshi Hasegawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 366 days.

(21) Appl. No.: 14/877,772

(22) Filed: Oct. 7, 2015

(65) Prior Publication Data

US 2016/0177961 A1 Jun. 23, 2016

(30) Foreign Application Priority Data

Dec. 19, 2014 (JP) ..... 2014-256936

(51) Int. Cl.
*F04D 29/056* (2006.01)
*F04D 25/02* (2006.01)
(Continued)

(52) U.S. Cl.
CPC ..... *F04D 29/056* (2013.01); *F04D 17/122* (2013.01); *F04D 25/02* (2013.01);
(Continued)

(58) Field of Classification Search
CPC ... F04D 29/04–29/042; F04D 29/046–29/052; F04D 29/056–29/063
See application file for complete search history.

(56) References Cited

U.S. PATENT DOCUMENTS 5,073,036 A 12/1991 Sutton et al.
8,302,754 B2 * 11/2012 Yagi ..... F16D 1/092 192/101
(Continued)

FOREIGN PATENT DOCUMENTS

GB 599304 * 12/1943
JP 58-196319 11/1983

OTHER PUBLICATIONS

Machine translation of JPS58196319.*
The Extended European Search Report dated Jun. 9, 2016 for the related European Patent Application No. 15189818.6.

*Primary Examiner* — Woody Lee, Jr.
*Assistant Examiner* — Brian O Peters
(74) *Attorney, Agent, or Firm* — McDermott Will & Emery LLP

(57) ABSTRACT

A turbo machine includes a rotation shaft that comprises a first taper portion and a first cylinder portion, the first taper portion decreasing in diameter toward one end of the rotation shaft, the first cylinder portion being constant in diameter in an axial direction of the rotation shaft; a first impeller that is fixed to the rotation shaft and that is used for compressing or expanding working fluid; a first bearing that rotatably supports the first taper portion and the first cylinder portion; and a second bearing that is positioned on an opposite side of the first impeller from the first bearing in the axial direction of the rotation shaft and that supports the rotation shaft both in the axial direction and a radial direction of the rotation shaft.

11 Claims, 7 Drawing Sheets

(51) Int. Cl.

| | |
|---|---|
| ***F04D 29/42*** | (2006.01) |
| ***F04D 29/051*** | (2006.01) |
| ***F04D 29/063*** | (2006.01) |
| ***F04D 29/28*** | (2006.01) |
| ***F04D 17/12*** | (2006.01) |
| ***F04D 29/053*** | (2006.01) |
| ***F04D 29/047*** | (2006.01) |
| ***F04D 29/057*** | (2006.01) |
| ***F04D 29/06*** | (2006.01) |

(52) U.S. Cl.
CPC ..... *F04D 29/047* (2013.01); *F04D 29/051* (2013.01); *F04D 29/053* (2013.01); *F04D 29/057* (2013.01); *F04D 29/061* (2013.01); *F04D 29/063* (2013.01); *F04D 29/284* (2013.01); *F04D 29/4206* (2013.01)

(56) References Cited

U.S. PATENT DOCUMENTS

| | | | | |
|---|---|---|---|---|
| 8,882,458 | B2 * | 11/2014 | Knoop | F04D 25/04 415/229 |
| 9,863,272 | B2 * | 1/2018 | Shoyama | F01D 25/16 |
| 2006/0216176 | A1 * | 9/2006 | Kaczmarek | F04B 27/04 417/521 |
| 2014/0227079 | A1 * | 8/2014 | Gilarranz | F04D 29/056 415/111 |

* cited by examiner

TURBO MACHINE

BACKGROUND

1. Technical Field

The present disclosure relates to a turbo machine.

2. Description of the Related Art

Existing turbo machines include a thrust bearing and a radial bearing, which are independent from each other. The thrust bearing supports an axial load (thrust load) generated due to a differential pressure between both surfaces of an impeller. The radial bearing supports a radial load. Some turbo machines include an angular ball bearing for supporting the thrust load and the radial load. Tapered roller bearings are known as bearings for supporting a rotation shaft.

FIG. 7 illustrates an air bearing device 500 described in Japanese Unexamined Patent Application Publication No. 58-196319, which includes a rotation shaft 501, a bearing member 503, a bearing member 504, an air bearing 506, an air bearing 507, a flow passage 508, and a flow passage 509. The air bearing 506 is disposed between the rotation shaft 501 and the bearing member 503. The air bearing 507 is disposed between the rotation shaft 501 and the bearing member 504. The flow passage 508 is formed in the bearing member, and the flow passage 509 is formed in the bearing member 504. Pressurized air is supplied to the air bearing 506 through the flow passage 508. Pressurized air is supplied to the air bearing 507 through the flow passage 509. The air bearing 506 and the air bearing 507 are tapered, and the large-diameter side of the air bearing 506 and the large-diameter side of the air bearing 507 face each other.

A pressure sensor 515 is disposed on the bearing surface of the bearing member 503. The pressure sensor 515 detects the pressure P in the air bearing 506, and an output signal p from the pressure sensor 515 is transmitted to a computing unit 516. The computing unit 516 converts the pressure P into a bearing clearance C and uses the bearing clearance C or the pressure P as a control signal. The value of the bearing clearance C is changed by moving the bearing member 503 rightward or leftward in FIG. 7 using a feed motor 514 so that the output signal p has a predetermined value. Thus, the bearing clearance C is maintained at the optimum value.

SUMMARY

The air bearing device described in Japanese Unexamined Patent Application Publication No. 58-196319 has room for improvement so that the bearing device can stably support a rotation shaft with a simple structure. One non-limiting and exemplary embodiment provides a turbo machine in which a rotation shaft is stably supported with a simple structure.

In one general aspect, the techniques disclosed here feature a turbo machine including a rotation shaft that comprises a first taper portion and a first cylinder portion, the first taper portion decreasing in diameter toward one end of the rotation shaft, the first cylinder portion being constant in diameter in an axial direction of the rotation shaft; a first impeller that is fixed to the rotation shaft and that is used for compressing or expanding working fluid; a first bearing that rotatably supports the first taper portion and the first cylinder portion; and a second bearing that is positioned on an opposite side of the first impeller from the first bearing in the axial direction of the rotation shaft and that supports the rotation shaft both in the axial direction and a radial direction of the rotation shaft.

With the present disclosure, it is possible to provide a turbo machine in which a rotation shaft is stably supported with a simple structure.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
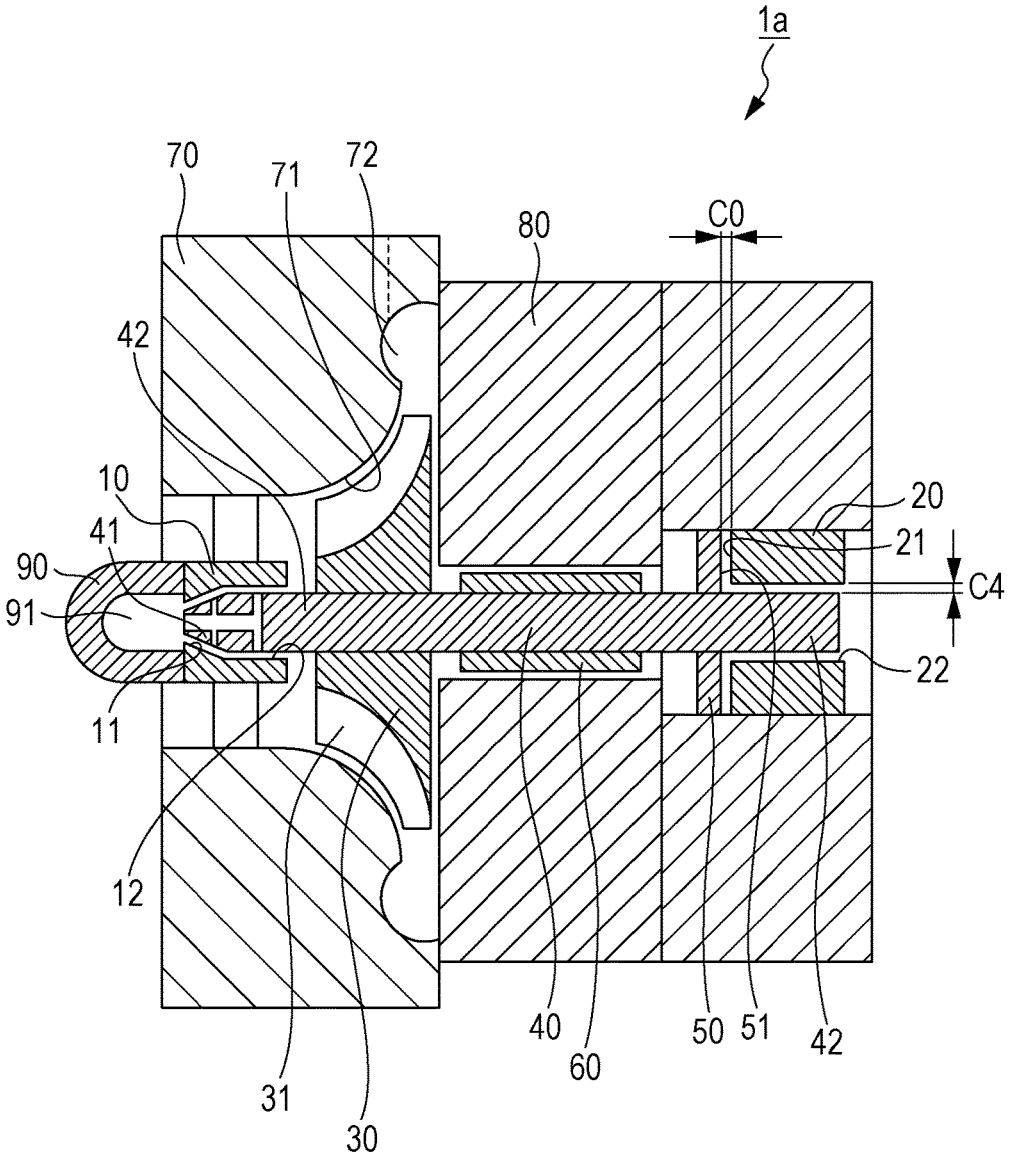
FIG. 1 is a sectional view of a turbo machine according to a first embodiment.

In a structure in which a fluid bearing supports a rotation shaft, a temperature difference generally occurs between the rotation shaft and a bearing member of the fluid bearing due to a factor such as frictional heat generated by the rotation of the rotation shaft or change in ambient temperature. Due to the temperature difference, a difference in thermal expansion occurs between these components and a clearance between the rotation shaft and the bearing member of the fluid bearing may fluctuate. Moreover, because the sizes of these components generally vary widely in the longitudinal direction of the rotation shaft, the initial clearance when these components are assembled varies considerably in the longitudinal direction of the rotation shaft. If the clearance between the rotation shaft and the bearing member of the fluid bearing becomes too large, a fluid pressure necessary for supporting the rotation shaft may not be generated, and movement of the rotation shaft may become unstable. On the other hand, if the clearance between the rotation shaft and the bearing member of the fluid bearing becomes too small, contact between the rotation shaft and the bearing member may occur, and the performance and the reliability of a device having the rotation shaft may considerably decrease.

The air bearing device 500 described in Japanese Unexamined Patent Application Publication No. 58-196319 can maintain the bearing clearance C at the optimum value. However, because the feed motor 514, the pressure sensor 515, and the computing unit 516 are necessary, the structure of the device is complex and the production costs of the device is high.

A first aspect of the present disclosure provides a turbo machine including a rotation shaft that comprises a first taper portion and a first cylinder portion, the first taper portion decreasing in diameter toward one end of the rotation shaft, the first cylinder portion being constant in diameter in an axial direction of the rotation shaft;

a first impeller that is fixed to the rotation shaft and that is used for compressing or expanding working fluid;

a first bearing that rotatably supports the first taper portion and the first cylinder portion; and a second bearing that is positioned on an opposite side of the first impeller from the first bearing in the axial direction of the rotation shaft and that supports the rotation shaft both in the axial direction and a radial direction of the rotation shaft.

With the first aspect, not only the first taper portion of the rotation shaft but also the first cylinder portion of the rotation shaft is supported. That is, the first cylinder portion of the rotation shaft is supported in the radial direction of the rotation shaft. Therefore, the turbo machine can be structured so that the rotation shaft is stably supported even if a thermal expansion difference in the axial direction of the rotation shaft occurs between the rotation shaft and the first bearing due to a temperature difference between the rotation shaft and the first bearing. Moreover, the structure of the turbo machine is simple, because a pressure sensor, an operation unit, and a motor for moving a bearing member are not necessary.

A second aspect of the present disclosure provides the turbo machine according to the first aspect, wherein the rotation shaft further includes a thrust bearing member that is located on the opposite side of the first impeller from the first bearing in the axial direction of the rotation shaft and that comprises a supporting surface which extends toward the radial direction of the rotation shaft; and a second cylinder portion that is located on the opposite side of the first impeller from the first bearing in the axial direction of the rotation shaft, and the second bearing comprises a thrust bearing surface that faces the supporting surface of the thrust bearing member. With the second aspect, the second bearing and the thrust bearing member can support the rotation shaft in the axial direction at a position on the opposite side of the first impeller from the first bearing.

A third aspect of the present disclosure provides the turbo machine according to the first aspect, wherein the rotation shaft further includes a second taper portion that is located on the opposite side of the first impeller from the first bearing in the axial direction of the rotation shaft and that decreases in diameter toward the other end of the rotation shaft, and a second cylinder portion that is constant in diameter, and a second bearing rotatably supports the second taper portion and the second cylinder portion on the opposite side of the first impeller from the first bearing. With the third aspect, the first bearing and the second bearing support not only the first and second taper portions but also the first and second cylinder portions. That is, the first and second cylinder portions are supported in the radial direction. Therefore, the turbo machine can be structured so that the rotation shaft is stably supported even if a thermal expansion difference in the axial direction of the rotation shaft occurs between the rotation shaft and the first bearing or between the rotation shaft and the second bearing due to a temperature difference between the rotation shaft and the first bearing or the second bearing.

A fourth aspect of the present disclosure provides the turbo machine according to any one of the first to third aspects further including a motor that is disposed on the rotation shaft between the first bearing and the second bearing and that is used for rotating the rotation shaft; and a second impeller that is fixed to the rotation shaft, wherein, with regard to the axial direction of the rotation shaft, the first bearing, the first impeller, the motor, the second impeller, and the second bearing are arranged in this order. With the fourth aspect, the two impellers, which exchange energy between the two impellers and the working fluid by making contact with the working fluid, and the motor, which generates heat when operating, are attached to the rotation shaft. Therefore, the temperature of the rotation shaft tends to rise. As a result, the temperature difference between the rotation shaft and the first bearing or the second bearing tends to increase. Even in such a case, the turbo machine can be structured so that the rotation shaft is stably supported.

A fifth aspect of the present disclosure provides the turbo machine according to any one of the first to fourth aspects, wherein the rotation shaft further includes a first main lubricant supply hole that extends from an inlet located at the one end of the rotation shaft in the axial direction of the rotation shaft; and a first backward sub lubricant supply hole that diverges from the first main lubricant supply hole and that extends to a first backward outlet in the radial direction of the rotation shaft, the first backward outlet being open to a space that is located between the first cylinder portion and the first bearing. With the fifth aspect, due to a centrifugal pumping effect produced by the rotation of the rotation shaft, a sufficient amount of lubricant is supplied to the space between the rotation shaft and the first bearing through the first main lubricant supply hole and the first backward outlet. Thus, while preventing extinction of a lubricating film due to depletion of lubricant, the rotation shaft can be sufficiently cooled by using the lubricant. As a result, the reliability of the turbo machine can be increased.

A sixth aspect of the present disclosure provides the turbo machine according to any one of the first to fourth aspects, wherein the rotation shaft further includes a first main lubricant supply hole that extends from an inlet located at the one end of the rotation shaft in the axial direction of the rotation shaft; and a first forward sub lubricant supply hole that diverges from the first main lubricant supply hole and that extends to a first forward outlet in the radial direction of the rotation shaft, the first forward outlet being open to a space that is located between the first taper portion and the first bearing. With the sixth aspect, due to a centrifugal pumping effect produced by the rotation of the rotation shaft, a sufficient amount of lubricant is supplied to the space between the rotation shaft and the first bearing through the first main lubricant supply hole and the first forward outlet. Thus, while preventing extinction of a lubricating film due to depletion of lubricant, the rotation shaft can be sufficiently cooled by using the lubricant. As a result, the reliability of the turbo machine can be increased.

A seventh aspect of the present disclosure provides the turbo machine according to any one of the first to fourth aspects, wherein the rotation shaft further includes a first main lubricant supply hole that extends from an inlet located at the one end of the rotation shaft in the axial direction of the rotation shaft; a first backward sub lubricant supply hole that diverges from the first main lubricant supply hole and that extends to a first backward outlet in the radial direction of the rotation shaft, the first backward outlet being open to a space that is located between the first cylinder portion and the first bearing; and a first forward sub lubricant supply hole that diverges from the first main lubricant supply hole and that extends to a first forward outlet in the radial direction of the rotation shaft, the first forward outlet being open to a space that is located between the first taper portion and the first bearing. With the seventh aspect, due to a centrifugal pumping effect produced by the rotation of the rotation shaft, a sufficient amount of lubricant is supplied to the space between the rotation shaft and the first bearing through the first main lubricant supply hole and the first backward outlet or the first forward outlet. Thus, while preventing extinction of a lubricating film due to depletion of lubricant, the rotation shaft can be sufficiently cooled by using the lubricant. As a result, the reliability of the turbo machine can be increased.

An eighth aspect of the present disclosure provides the turbo machine according to any one of the fifth to seventh aspects, wherein the first backward sub lubricant supply hole has a diameter which is smaller than that of the first main lubricant supply hole. With the eighth aspect, due to a centrifugal pumping effect produced by the rotation of the rotation shaft, excessive supply of lubricant to the space between the first bearing ember and the rotation shaft can be suppressed. Thus, occurrence of cavitation in lubricant, which may occur due to a decrease in the pressure of lubricant in the first main lubricant supply hole, can be prevented.

A ninth aspect of the present disclosure provides the turbo machine according to any one of the fifth to eighth aspects, further including a first lubricant case that is connected to the first bearing and that has a space for storing lubricant which is supplied to the first bearing. With the ninth aspect, because the lubricant is stored in the space that is formed in the lubricant case and that is connected to the first main lubricant supply hole, the amount of lubricant supplied to the space between the first bearing and the rotation shaft can be appropriately adjusted in accordance with a change in the rotation speed of the rotation shaft. Thus, lubricant depletion can be prevented.

A tenth aspect of the present disclosure provides the turbo machine according to the second aspect, wherein the turbo machine satisfies a formula: $C0+C1>C3+C4$, wherein, C0 is a clearance between the supporting surface of the thrust bearing member and the thrust bearing surface of the second bearing, C1 is an average clearance between the first taper portion and the first bearing in a direction perpendicular to an outer surface of the first taper portion, C3 is an average clearance between the first cylinder portion and the first bearing, and C4 is an average clearance between the second cylinder portion and the second bearing. With the tenth aspect, the clearance between the second bearing the thrust bearing member in the axial direction of the rotation shaft and the clearance between the first taper portion and the first bearing in the direction perpendicular to the outer surface of the first taper portion are larger than the clearance between the first bearing or the second bearing and the rotation shaft in the radial direction of the rotation shaft. Therefore, even when the temperature of the rotation shaft rises and the rotation shaft expands in the axial direction, sufficient clearances can be provided between the first taper portion and the first bearing and between the thrust bearing member and the second bearing. Thus, contact between the rotation shaft and the bearings can be prevented.

An eleventh aspect of the present disclosure provides the turbo machine according to the third aspect, wherein the turbo machine satisfies a formula: $C1+C2>C3+C4$, wherein, C1 is an average clearance between the first taper portion and the first bearing in a direction perpendicular to an outer surface of the first taper portion, C2 is an average clearance between the second taper portion and the second bearing in the direction perpendicular to the outer surface of the second taper portion, C3 is an average clearance between the first cylinder portion and the first bearing, and C4 is an average clearance between the second cylinder portion and the second bearing. With the eleventh aspect, the clearance between the first or second taper portion and the first bearing or the second bearing in the direction perpendicular to the outer surface of the first or second taper portion is larger than the clearance between the first bearing or the second bearing and the rotation shaft and in the radial direction of the rotation shaft. Therefore, even when the temperature of the rotation shaft rises and the rotation shaft expands in the axial direction, sufficient clearances can be provided between the first taper portion and the first bearing and between the second taper portion and the second bearing. Thus, contact between the rotation shaft and the bearings can be prevented.

A twelfth aspect of the present disclosure provides the turbo machine according to the fourth aspect, further including a first casing that has an inner surface which is disposed around a low-pressure surface of the first impeller, and a second casing that has an inner surface which is disposed around a low-pressure surface of the second impeller, wherein the turbo machine satisfies formulas: $C5>C1+C2$ and $C6>C1+C3$, wherein, C1 is an average clearance between the first taper portion and the first bearing in a direction perpendicular to an outer surface of the first taper portion, C2 is an average clearance between the second taper portion and the second bearing in the direction perpendicular to the outer surface of the second taper portion, C5 is a minimum clearance between the inner surface of the first casing and the first impeller in the axial direction, C6 is a minimum clearance between the inner surface of the second casing and the second impeller in the axial direction. With the twelfth aspect, even if the rotation shaft moves maximally in the axial direction or the rotation shaft expands considerably in the axial direction, it is possible to prevent occurrence of a dangerous situation, such as breakage of a component due to contact between the first impeller and the first casing or contact between the second impeller and the second casing.

A thirteenth aspect of the present disclosure provides the turbo machine according to any one of the first to twelfth aspects, wherein the working fluid is used as lubricant that is supplied to the first bearing or the second bearing. With the thirteenth aspect, because the working fluid is used as the lubricant, compared with a case where a fluid that is different from the working fluid is used as the lubricant, the running costs of the turbo machine can be reduced. Moreover, contamination of the working fluid by the lubricant can be prevented.

A fourteenth aspect of the present disclosure provides the turbo machine, according to the third aspect, wherein the size of the first bearing is the same as that of the second bearing, and the material of the first bearing is the same as that of the second bearing. With the fourteenth aspect, the first bearing and the second bearing expand to substantially the same degree when temperature changes. Therefore, a load with which the first bearing supports the rotation shaft and a load with which the second bearing supports the rotation shaft are unlikely to vary widely, so that the rotation shaft can be stably held. Moreover, because the same components can be used for the first bearing and the second bearing, the production costs of the turbo machine can be reduced.

A fifteenth aspect of the present disclosure provides the turbo machine according to any one of the first to fourteenth aspects, wherein the working fluid has a negative saturated vapor pressure at a normal temperature. With the fifteenth aspect, the working fluid discharged from the turbo machine may have a negative pressure in some case. In such a case, a thrust load generated in the axial direction of the rotation shaft is very low, so that a load to be received by the first bearing or the second bearing is very low. Thus, components such as the first bearing and the second bearing can be reduced in size, and the production costs of the turbo machine can be reduced. Note that, in the present specification, the term "normal temperature" refers to a temperature in the range of 20° C.±15° C. in accordance with JIS (Japan Industrial Standard) Z8703. The term "negative pressure" refers to a pressure that is lower than the atmospheric pressure in absolute terms.

A sixteenth aspect of the present disclosure provides the turbo machine according to any one of the first to fourth aspects, wherein the rotation shaft further includes a first main lubricant supply hole that extends from an inlet located at the one end of the rotation shaft in the axial direction of the rotation shaft; a first backward sub lubricant supply hole that diverges from the first main lubricant supply hole and that extends to a first backward outlet in the radial direction of the rotation shaft, the first backward outlet being open to a space that is located between the first cylinder portion and the first bearing; a first forward sub lubricant supply hole that diverges from the first main lubricant supply hole and that extends to a first forward outlet in the radial direction of the rotation shaft, the first forward outlet being open to a space that is located between the first taper portion and the first bearing; a second main lubricant supply hole that extends from an inlet located at the other end of the rotation shaft in the axial direction of the rotation shaft; a second backward sub lubricant supply hole that diverges from the second main lubricant supply hole and that extends to a second backward outlet in the radial direction of the rotation shaft, the second backward outlet being open to a space that is located between the second cylinder portion and the second bearing; and a second forward sub lubricant supply hole that diverges from the second main lubricant supply hole and that extends to a second forward outlet in the radial direction of the rotation shaft, the second forward outlet being open to a space that is located between the second taper portion and the second bearing.

Hereinafter, embodiments of the present disclosure will be described with reference to the drawings. The following descriptions relate to an example of the present disclosure, and the present disclosure is not limited by the descriptions.

First Embodiment

As illustrated in FIG. 1, a turbo machine 1*a* according to a first embodiment includes a rotation shaft 40, at least one impeller 30, a first bearing 10, and a second bearing 20. The rotation shaft 40 includes a taper portion 41 (first taper portion) and a cylinder portion 42 (first cylinder portion). The taper portion 41 decreases in diameter toward one end of the rotation shaft 40. The cylinder portion 42 is constant in diameter in the axial direction. The impeller 30 is fixed to the rotation shaft 40 and is used for compressing and expanding working fluid. The first bearing 10 rotatably supports the taper portion 41 and the cylinder portion 42 at a position in front of or behind the impeller 30. When the turbo machine 1*a* is operating, working fluid flows from a position in front of the impeller 30 toward the impeller 30. The second bearing 20 is positioned on an opposite side of the impeller 30 from the first bearing 10 in the axial direction of the rotation shaft 40 and supports the rotation shaft 40 both in the axial direction and the radial direction of the rotation shaft 40. The first bearing 10 and the second bearing 20 are each a plain bearing. That is, lubricant exists between the first bearing 10 and the taper portion 41 and between the first bearing 10 and the cylinder portion 42, and lubricant exists between the second bearing 20 and the rotation shaft 40.

The turbo machine 1*a* is, for example, a centrifugal turbo machine, such as a centrifugal turbocompressor. The turbo machine 1*a* may be an axial-flow turbo machine or a turbine. As illustrated in FIG. 1, the turbo machine 1*a* includes, for example, a motor 60, a casing 70, and a motor casing 80. The motor 60 is attached to the rotation shaft 40 at a position between the first bearing 10 and the second bearing 20. The motor 60 rotates the rotation shaft 40. The impeller 30 and the motor 60 are connected to each other through the rotation shaft 40. The impeller 30 has a front surface 31. The front surface 31 of the impeller 30 faces forward. The casing 70 has an inner surface 71 that is located outside of the impeller 30 in the radial direction and that surrounds the front surface 31 of the impeller 30. A discharge passage 72 is formed in the casing 70 at a position outside of the impeller 30 in the radial direction. The motor casing 80 is a cylindrical casing, and the motor 60 is disposed in the motor casing 80. The motor 60 rotates the rotation shaft 40 and the impeller 30 together at high speed. Thus, working fluid flows from a position in front of the impeller 30 (the left side of the impeller 30 in FIG. 1) toward the impeller 30. The working fluid is accelerated and pressurized by the rotating impeller, passes through the discharge passage 72, and is discharged from the turbo machine 1*a*. The front surface 31 receives a suction pressure of the working fluid, and a surface of the impeller 30 on the right side in FIG. 1 receives a pressure that is approximately the same as the discharge pressure of the working fluid. Therefore, a pressure difference occurs between the surfaces of the impeller 30 facing in the axial direction. Due to the pressure difference, a thrust load is applied to a rotating body, including the rotation shaft 40 and the impeller 30, in the leftward direction in FIG. 1.

The taper portion 41 decreases in diameter, for example, toward an end of the rotation shaft 40 in front of the impeller 30. In other words, the taper portion 41 increases in diameter toward the impeller 30. The cylinder portion 42 of the rotation shaft 40 is located closer to the impeller 30 than the taper portion 41 is. For example, in the rotation shaft 40, the outer surface of the taper portion 41 is continuous with the outer surface of the cylinder portion 42. The first bearing 10 is disposed, for example, in front of the impeller 30. The first bearing 10 has a bearing hole that is formed by a taper bearing surface 11 for supporting the taper portion 41 and a bearing hole that is formed by a straight bearing surface 12 for supporting the cylinder portion 42. The taper bearing surface 11 is a conical surface that is inclined with respect to the axis of the bearing hole formed by the taper bearing surface 11. The taper bearing surface 11 forms a tapered hole that is slightly larger in diameter than the taper portion 41. That is, the taper bearing surface 11 forms a tapered hole that increases in diameter toward the impeller 30. Thus, the thrust load that is generated when the impeller 30 rotates at high speed is supported. The straight bearing surface 12 is a cylindrical surface that extends parallel to the axis of the bearing hole formed by the straight bearing surface 12. With such a structure, the first bearing 10 rotatably supports the taper portion 41 and the cylinder portion 42. For example, the first bearing 10 supports a portion of the rotation shaft 40 near the end of the rotation shaft 40 in front of the impeller 30.

The rotation shaft 40 further includes a cylinder portion 42 (second cylinder portion) near an end of the rotation shaft 40 behind the impeller 30. The second bearing 20 is disposed, for example, behind the impeller 30. The second bearing 20 has a bearing hole that forms a straight bearing surface 22 that faces the cylinder portion 42 (second cylinder portion). The straight bearing surface 22 is, for example, a cylindrical surface that extends parallel to the axis of the bearing hole formed by the straight bearing surface 22. The straight bearing surface 22 of the second bearing 20 supports the rotation shaft 40 in the radial direction. The turbo machine 1*a* further includes a thrust bearing member 50. The thrust bearing member 50 is attached to the rotation shaft 40 at a position on an opposite side of the impeller 30 from the first bearing 10. The thrust bearing member 50 includes a supporting surface 51 that extends in the radial direction of the rotation shaft 40. The thrust bearing member 50 is, for example, a plate-shaped member through which the rotation shaft 40 extends. The second bearing 20 has a thrust bearing surface 21 that faces the supporting surface 51 of the thrust bearing member 50. The supporting surface 51 and the thrust bearing surface 21 restrict movement of the rotation shaft 40 in the axial direction. During a transient driving period, such as a period from a time at which the turbo machine 1*a* is started to a time at which the turbo machine 1*a* performs a steady operation, the pressure of working fluid on the left side of the impeller 30 in FIG. 1 is not necessarily lower than that on the right side of the impeller 30 in FIG. 1. In such a case, the thrust bearing member 50 and the second bearing 20 prevent the rotation shaft 40 from being moved rightward in FIG. 1.

When the impeller 30 rotates at high speed, the rotation shaft 40 may thermally expand due to, for example, frictional heat, heat generated by the motor 60, or the effect of ambient temperature near the rotation shaft 40. At this time, a temperature difference may occur between the rotation shaft 40 and the first bearing 10, and a thermal expansion difference may occur between the rotation shaft 40 and the first bearing 10. The first bearing 10 supports not only the taper portion 41 of the rotation shaft 40 but also the cylinder portion 42 of the rotation shaft 40. Thus, the rotation shaft 40 is supported in the radial direction. Moreover, the second bearing 20 supports the rotation shaft 40 in the radial direction. Therefore, even if a thermal expansion difference occurs between the rotation shaft 40 and the first bearing 10, the rotation shaft 40 is stably supported.

Figure 2:
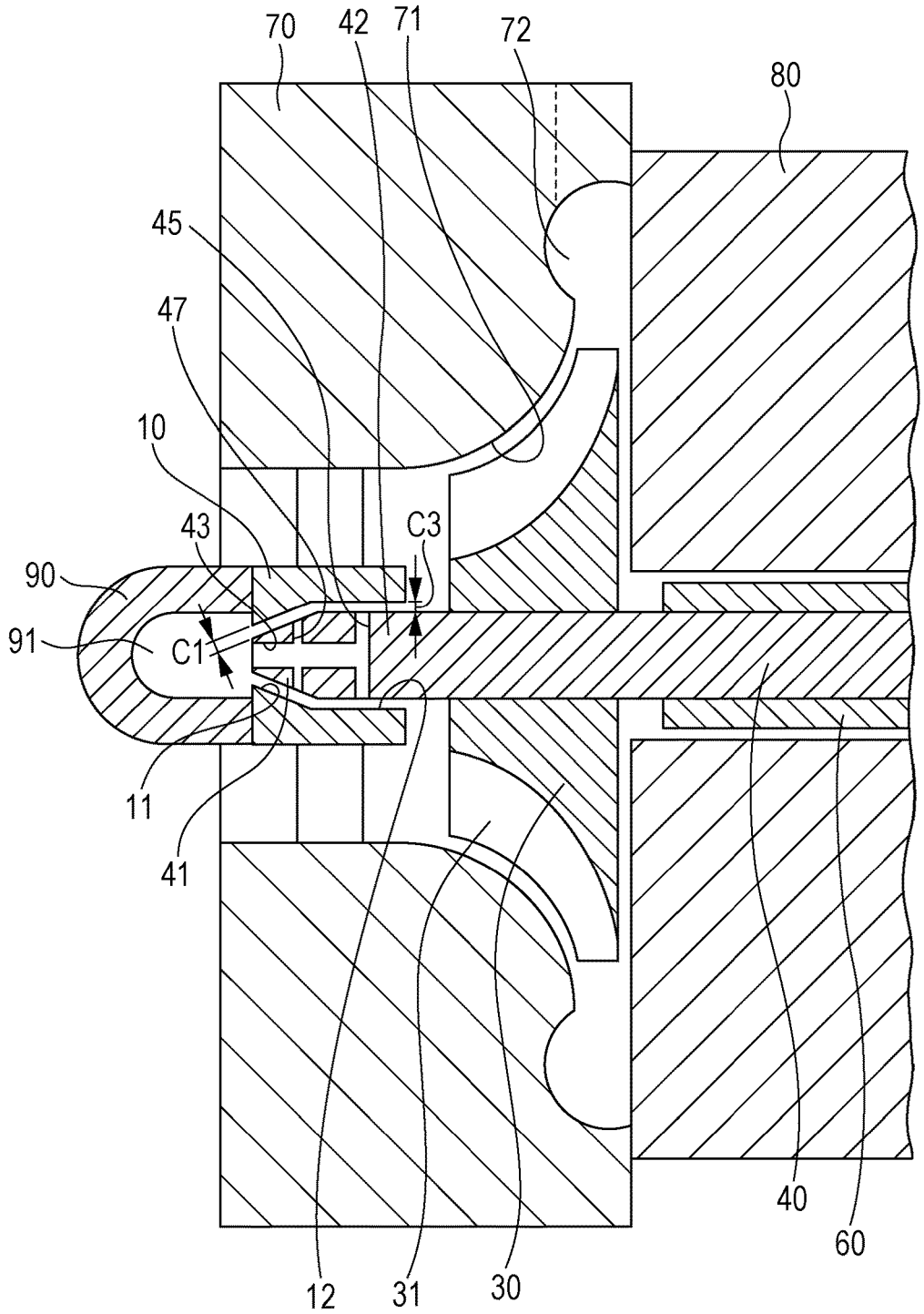
FIG. 2 is a partial enlarged sectional view of the turbo machine illustrated in FIG. 1.

The turbo machine 1*a* satisfies, for example, a formula: $C0+C1>C3+C4$, wherein, as illustrated in FIGS. 1 and 2, C0 is a clearance between the supporting surface 51 of the thrust bearing member 50 and the thrust bearing surface 21 of the second bearing 20, C1 is the average clearance between the taper portion 41 (first taper portion) and the first bearing 10 in a direction perpendicular to the outer surface of the taper portion 41 (first taper portion), C3 is the average clearance between the cylinder portion 42 (first cylinder portion) and the first bearing 10, and C4 is the average clearance between the cylinder portion 42 (second cylinder portion) and the second bearing 20. Here, the average clearance C1 is the average value of clearance around the rotation shaft 40 at an end of the taper bearing surface 11 in the axial direction of the rotation shaft 40, when it is assumed that the axis of the rotation shaft 40 coincides with the axis of the bearing hole of the first bearing 10. The average clearance C3 is the average value of clearance around the rotation shaft 40 at an end of the straight bearing surface 12 in the axial direction of the rotation shaft 40, when it is assumed that the axis of the rotation shaft 40 coincides with the axis of the bearing hole of the first bearing 10. The average clearance C4 is the average value of clearance around the entire periphery of the rotation shaft 40 at an end of the straight bearing surface 22 closer to an end of the rotation shaft 40 in the axial direction of the rotation shaft 40 or at the end of the rotation shaft 40, when it is assumed that the axis of the rotation shaft 40 coincides with the axis of the bearing hole of the second bearing 20. The values of the clearance C0, the average clearance C1, the average clearance C3, and the average clearance C4 are those at normal temperature. An average clearance, which has a dimension of length, can be obtained by, for example, dividing the area of a region corresponding to the clearance when the clearance is viewed along the axis of the rotation shaft 40 by the length of the outer surface of the rotation shaft 40.

When the rotation shaft 40 thermally expands, because the rotation shaft 40 is long in the axial direction, the thermal expansion amount of the rotation shaft 40 in the axial direction is considerably larger than that in the radial direction. Therefore, preferably, the turbo machine 1*a* satisfies the aforementioned formula. In this case, even when the temperature of the rotation shaft 40 rises and the rotation shaft 40 expands in the axial direction, sufficient clearances can be provided between the taper portion 41 (first taper portion) and the first bearing 10 and between the thrust bearing member 50 and the second bearing 20. As a result, contact between the rotation shaft 40 and the first bearing 10 and contact between the rotation shaft 40 and the second bearing 20 can be prevented.

As illustrated in FIG. 2, the rotation shaft 40 includes, for example, a main lubricant supply hole 43 (first main lubricant supply hole), a backward sub lubricant supply hole 45 (first backward sub lubricant supply hole), and a forward sub lubricant supply hole 47 (first forward sub lubricant supply hole). The main lubricant supply hole 43 extends from at least one of the ends of the rotation shaft 40 in the axial direction. The backward sub lubricant supply hole 45 diverges from the main lubricant supply hole 43 and extends to a backward outlet (first backward outlet) in the radial direction. The backward outlet is open to a space that is located between the cylinder portion 42 (first cylinder portion) and the first bearing 10. The forward sub lubricant supply hole 47 diverges from the main lubricant supply hole 43 and extends to a forward outlet (first forward outlet) in the radial direction. The forward outlet is open to a space that is located between the taper portion 41 (first taper portion) and the first bearing 10. Lubricant, for lubrication between the first bearing 10 and the rotation shaft 40, is supplied to the main lubricant supply hole 43. Due to a centrifugal pumping effect produced by the rotation of the rotation shaft 40, the lubricant supplied to the main lubricant supply hole 43 passes through the backward sub lubricant supply hole 45 or the forward sub lubricant supply hole 47 and is supplied to a space between the first bearing 10 and the rotation shaft 40. Thus, a sufficient amount of lubricant can be supplied to the space between the first bearing 10 and the rotation shaft 40. Moreover, the rotation shaft 40 can be sufficiently cooled by using the lubricant. One of the backward sub lubricant supply hole 45 and the forward sub lubricant supply hole 47 may be omitted. Even in this case, substantially the same effect can be obtained by appropriately determining the shape or the size of each of the main lubricant supply hole 43 and the backward sub lubricant supply hole 45 or the forward sub lubricant supply hole 47.

The diameter of the backward sub lubricant supply hole 45 or the diameter or the forward sub lubricant supply hole 47 is smaller than, for example, that of the main lubricant supply hole 43. In this case, excessive supply of lubricant to the space between the first bearing 10 and the rotation shaft 40 can be prevented. Moreover, decrease in the pressure of lubricant in a lubricant supply hole due to excessive supply of the lubricant can be suppressed, and occurrence of cavitation of the lubricant in the lubricant supply hole can be prevented.

As illustrated in FIG. 2, the turbo machine 1*a* further includes, for example, a lubricant case 90. The lubricant case 90 has a storage space 91. The storage space 91 is a space that is connected to the main lubricant supply hole 43 and that stores lubricant to be supplied to the first bearing 10. The amount of lubricant supplied to the first bearing 10 varies in accordance with the rotation speed of the rotation shaft 40. Because lubricant is stored in the storage space 91, the amount of the lubricant supplied to the first bearing 10 can be appropriately adjusted in accordance with variation in the amount of lubricant. Thus, lubricant depletion can be prevented. As illustrated in FIG. 2, preferably, an end of the rotation shaft 40 is exposed to the storage space 91. In this case, the rotation shaft 40 is cooled by using the lubricant stored in the storage space 91. More preferably, an end of the taper portion 41 of the rotation shaft 40 is exposed to the storage space 91. In this case, because the area of a portion of the rotation shaft 40 exposed to the storage space 91 is small, the amount of energy loss that occurs when the rotation shaft 40 stirs the lubricant stored in the storage space 91 can be reduced.

Working fluid used in the turbo machine 1*a* is not particularly limited. For example, the working fluid is a fluid that has a negative saturated vapor pressure at normal temperature. Examples of such a fluid include water, alcohol, and a fluid containing ether as a main component. When such a fluid, which has a negative saturated vapor pressure at normal temperature, is used as working fluid, the working fluid has a negative pressure when it is discharged from the turbo machine 1*a*. Therefore, a thrust load generated when the impeller 30 rotates at high speed is very low, so that a bearing load to be received by the first bearing 10 is very low. Therefore, the first bearing 10 can be reduced in size. As a result, the production costs of the turbo machine 1*a* can be reduced.

Lubricant that is used for lubrication between the first bearing 10 and the rotation shaft and between the second bearing 20 and the rotation shaft 40 is not particularly limited. For example, the working fluid of the turbo machine 1*a* may be used as the lubricant. In this case, compared with a case where a fluid that is different from the working fluid is used as the lubricant, the running costs of the turbo machine 1*a* can be reduced. Moreover, contamination of the working fluid by the lubricant can be prevented.

Modifications

The turbo machine 1*a* according to the first embodiment may be modified in various ways. For example, the first bearing 10 may be disposed behind the impeller 30, and the second bearing 20 may be disposed in front of the impeller 30.

A portion of the first bearing 10 for supporting the taper portion 41 (first taper portion) and a portion of the first bearing 10 for supporting the cylinder portion 42 (first cylinder portion) may be independent from each other. In this case, it is not necessary to machine a single workpiece to form both the taper bearing surface 11 and the straight bearing surface 12, so that restraints on the shapes of machining tools can be reduced. Thus, the first bearing 10 can be machined easily. Moreover, the first bearing 10 can be designed more freely. In this case, the portion of the first bearing 10 for supporting the taper portion 41 and the portion of the first bearing 10 for supporting the cylinder portion 42 may be connected to each other by using a screw or may be disposed separated from each other in the axial direction of the rotation shaft 40.

Figure 3:
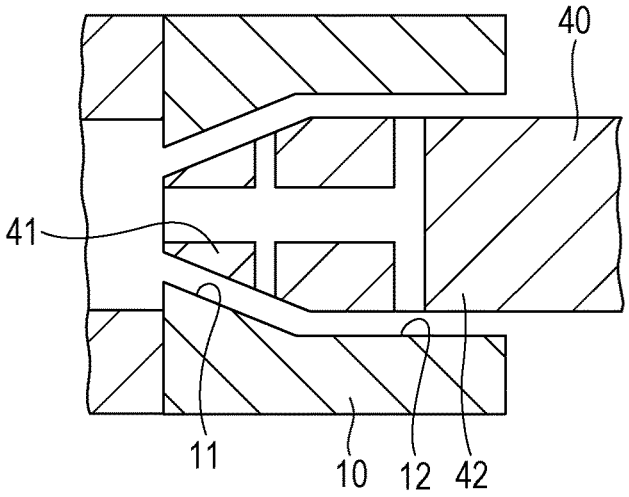
FIG. 3 is a partial enlarged sectional view of a turbo machine according to a modification.

As illustrated in FIG. 3, the first bearing 10 may be, for example, machined so that the first bearing 10 has a curved corner at the boundary between the taper bearing surface 11 and the straight bearing surface 12, when the rotation shaft 40 is viewed in a direction perpendicular to the axis of the rotation shaft 40. In this case, high precision is not required for the shape of the first bearing 10 at the boundary between the taper bearing surface 11 and the straight bearing surface 12 or for the surface roughness at the boundary between the taper bearing surface 11 and the straight bearing surface 12. Therefore, the first bearing 10 can be machined easily, and the production costs of the first bearing 10 can be reduced. As illustrated in FIG. 3, the rotation shaft 40 may be machined, for example, so that the rotation shaft 40 has a curved ridge at the boundary between the outer surface of the taper portion 41 and the outer surface of the cylinder portion 42, the ridge having substantially the same curvature as the corner at the boundary between the taper bearing surface 11 and the straight bearing surface 12, when the rotation shaft 40 is viewed in a direction perpendicular to the axis of the rotation shaft 40. In this case, a "burr", which may have a negative effect on lubrication between the first bearing 10 and the rotation shaft 40, is not easily generated, so that the reliability of the turbo machine 1*a* can be increased.

Figure 4:
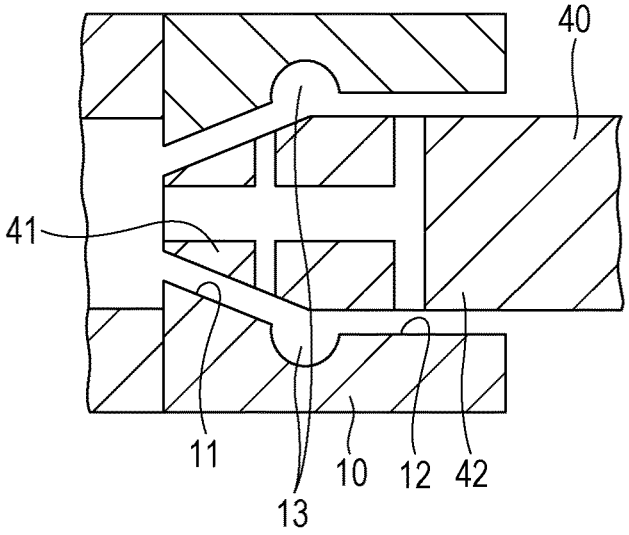
FIG. 4 is a partial enlarged sectional view of a turbo machine according to another modification.

As illustrated in FIG. 4, the first bearing 10 may be machined so as to have a relief space 13 at the boundary between the taper bearing surface 11 and the straight bearing surface 12. In this case, high precision is not required for the shape of the first bearing 10 at the boundary between the taper bearing surface 11 and the straight bearing surface 12 or for the surface roughness at the boundary between the taper bearing surface 11 and the straight bearing surface 12. Therefore, the first bearing 10 can be machined easily, and the production costs of the first bearing 10 can be reduced.

Second Embodiment

Next, a turbo machine 1*b* according to a second embodiment will be described. Unless otherwise noted, the turbo machine 1*b* has the same structure as the turbo machine 1*a*. Elements of the turbo machine 1*b* that are the same as those of the turbo machine 1*a* or that correspond to those of the turbo machine 1*a* will be denoted by the same numerals, and the detailed descriptions of such elements may be omitted. Descriptions in the first embodiment are applicable to the second embodiment unless they are technologically contradictory.

Figure 5:
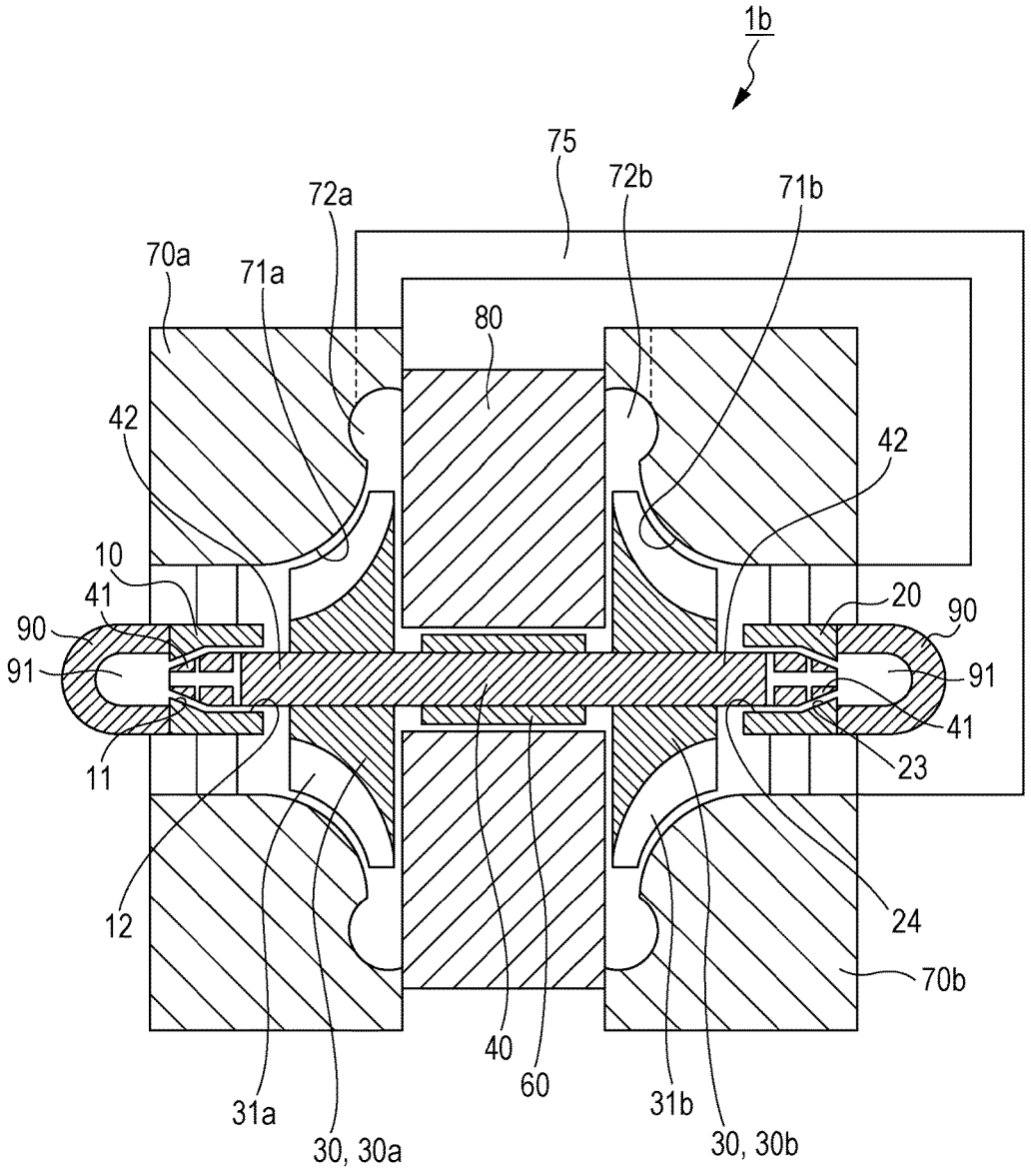
FIG. 5 is a sectional view of a turbo machine according to a second embodiment.

As illustrated in FIG. 5, a rotation shaft 40 of the turbo machine 1*b* includes two taper portions 41 each of which decreases in diameter to a corresponding one of the ends of the rotation shaft 40. A second bearing 20 is positioned on an opposite side of an impeller 30 from the first bearing 10 in the axial direction of the rotation shaft 40 and rotatably supports a taper portion 41 (second taper portion) and a cylinder portion 42 (second cylinder portion) in the axial direction of the rotation shaft 40. The rotation shaft 40 has a main lubricant supply hole 43, a backward sub lubricant supply hole 45, and a forward sub lubricant supply hole 47 at each of the ends of the rotation shaft 40. In one end portion of the rotation shaft 40 adjacent to the second bearing 20, a backward sub lubricant supply hole 45 (second backward sub lubricant supply hole) diverges from a main lubricant supply hole 43 (second main lubricant supply hole) and extends in the radial direction toward a backward outlet (second backward outlet). The backward outlet is open to a space that is located between the cylinder portion 42 and the second bearing 20. In the end portion of the rotation shaft 40 adjacent to the second bearing 20, a forward sub lubricant supply hole 47 (second forward sub lubricant supply hole) diverges from the main lubricant supply hole 43 and extends in the radial direction toward a forward outlet. The forward outlet (second forward outlet) is open to a space between the taper portion 41 (second taper portion) and the second bearing 20. In the end portion of the rotation shaft 40 adjacent to the second bearing 20, one of the backward sub lubricant supply hole 45 and the forward sub lubricant supply hole 47 may be omitted.

The turbo machine 1*b* includes, as at least one impeller 30, a first impeller 30*a* and a second impeller 30*b*. The first impeller 30*a* is attached to the rotation shaft 40 at a position between the first bearing 10 and the motor 60. The second impeller 30*b* is fixed to the rotation shaft 40 at a position between the second bearing 20 and the motor 60. The first impeller 30*a* has a front surface 31*a* that faces forward from the first impeller 30*a*, and the second impeller 30*b* has a front surface 31*b* that faces forward from the second impeller 30*b*. The first impeller 30*a* and the second impeller 30*b* are fixed to the rotation shaft 40 to that the front surface 31*a* and the front surface 31*b* face in opposite directions. That is, the forward direction for the first impeller 30*a* is opposite to that for the second impeller 30*b*.

The turbo machine 1*b* is, for example, a centrifugal turbocompressor. The turbo machine 1*b* further includes a first casing 70*a* and a second casing 70*b*. The first casing 70*a* has an inner surface 71*a* that is located outside of the first impeller 30*a* in the radial direction and that surrounds the front surface 31*a* of the first impeller 30*a*. The second casing 70*b* has an inner surface 71*b* that is located outside of the second impeller 30*b* in the radial direction and that surrounds the front surface 31*b* of the second impeller 30*b*. A discharge passage 72*a* is formed in the first casing 70*a* at a position outside of the first impeller 30*a* in the radial direction. A discharge passage 72*b* is formed in the second casing 70*b* at a position outside of the second impeller 30*b* in the radial direction. The turbo machine 1*b* further includes a connection passage 75. The connection passage 75 connects the discharge passage 72*a* of the first casing 70*a* to a space in front of the second impeller 30*b*.

The motor 60 rotates the rotation shaft 40, the first impeller 30*a*, and the second impeller 30*b* together at high speed. Thus, working fluid in front of the first impeller 30*a* passes through the first impeller 30*a* and is compressed. The working fluid, which has passed through the first impeller 30*a* and compressed, passes through the discharge passage 72*a* and the connection passage 75 and is guided to the space in front of the second impeller 30*b*. The working fluid in front of the second impeller 30*b* passes through the second impeller 30*b* and is further compressed. The working fluid, which has passed through the second impeller 30*b* and compressed, passes through the discharge passage 72*b* and is discharged to the outside of the turbo machine 1*b*. Thus, because the working fluid is compressed in two steps by the first impeller 30*a* and the second impeller 30*b*, the turbo machine 1*b* has high compression efficiency and can achieve a high compression ratio.

When the turbo machine 1*b* is performing a steady operation, the front surface 31*a* of the first impeller 30*a* receives a suction pressure of the working fluid, and the surface of the first impeller 30*a* on the right side in FIG. 5 receives a pressure that is substantially equal to the intermediate pressure of the working fluid. The front surface 31*b* of the second impeller 30*b* receives a suction pressure of the working fluid, and the surface of the second impeller 30*b* on the left side in FIG. 5 receives a pressure that is substantially equal to the discharge pressure of the working fluid. Therefore, a thrust load is generated in the leftward direction in FIG. 5 due to the rotation of the first impeller 30*a*, and a thrust load is generated in the rightward direction in FIG. 5 due to the rotation of the second impeller 30*b*. That is, the direction of the thrust load generated due to the rotation of the first impeller 30*a* is opposite to the direction of the thrust load generated due to the rotation of the second impeller 30*b*. Therefore, these thrust loads cancel out each other, and therefore the turbo machine 1*b* has a wide range of operable compression ratio.

The second bearing 20 is disposed in front of the second impeller 30*b*. The second bearing 20 has a bearing hole formed by a taper bearing surface 23 for supporting the taper portion 41 (second taper portion) and a bearing hole formed by a straight bearing surface 24 for supporting the cylinder portion 42 (second cylinder portion). The taper bearing surface 23 is a conical surface that is inclined with respect to the axis of the bearing hole formed by the taper bearing surface 23. The taper bearing surface 23 forms a tapered hole that is slightly larger in diameter than the taper portion 41. That is, the taper bearing surface 23 forms a taper hole that increases in diameter toward the second impeller 30*b*. Thus, the thrust load in the rightward direction in FIG. 5 is supported. The straight bearing surface 24 is a cylindrical surface that extends parallel to the axis of the bearing hole formed by the straight bearing surface 24. With such a structure, the second bearing 20 rotatably supports the taper portion 41 and the cylinder portion 42. In the turbo machine 1*b*, the motor 60 and the two impellers 30 (the first impeller 30*a* and the second impeller 30*b*), each of which generates heat, are attached to the rotation shaft 40. Therefore, when the two impellers 30 rotate, the temperature of the rotation shaft 40 tends to rise. Therefore, the temperature difference between the rotation shaft 40 and the first bearing 10 or the second bearing 20 tends to increase and the thermal expansion difference between the rotation shaft 40 and the first bearing 10 or the second bearing 20 tends to increase. Even in such a case, because the first bearing 10 and the second bearing 20 support the rotation shaft 40 in the radial direction, the rotation shaft 40 is stably supported.

As illustrated in FIG. 5, the turbo machine 1*b* includes, for example, two lubricant cases 90. Each of the two lubricant cases 90 is disposed on an opposite side of a corresponding one of the ends of the rotation shaft 40 in the axial direction of the rotation shaft 40.

Figure 6A:
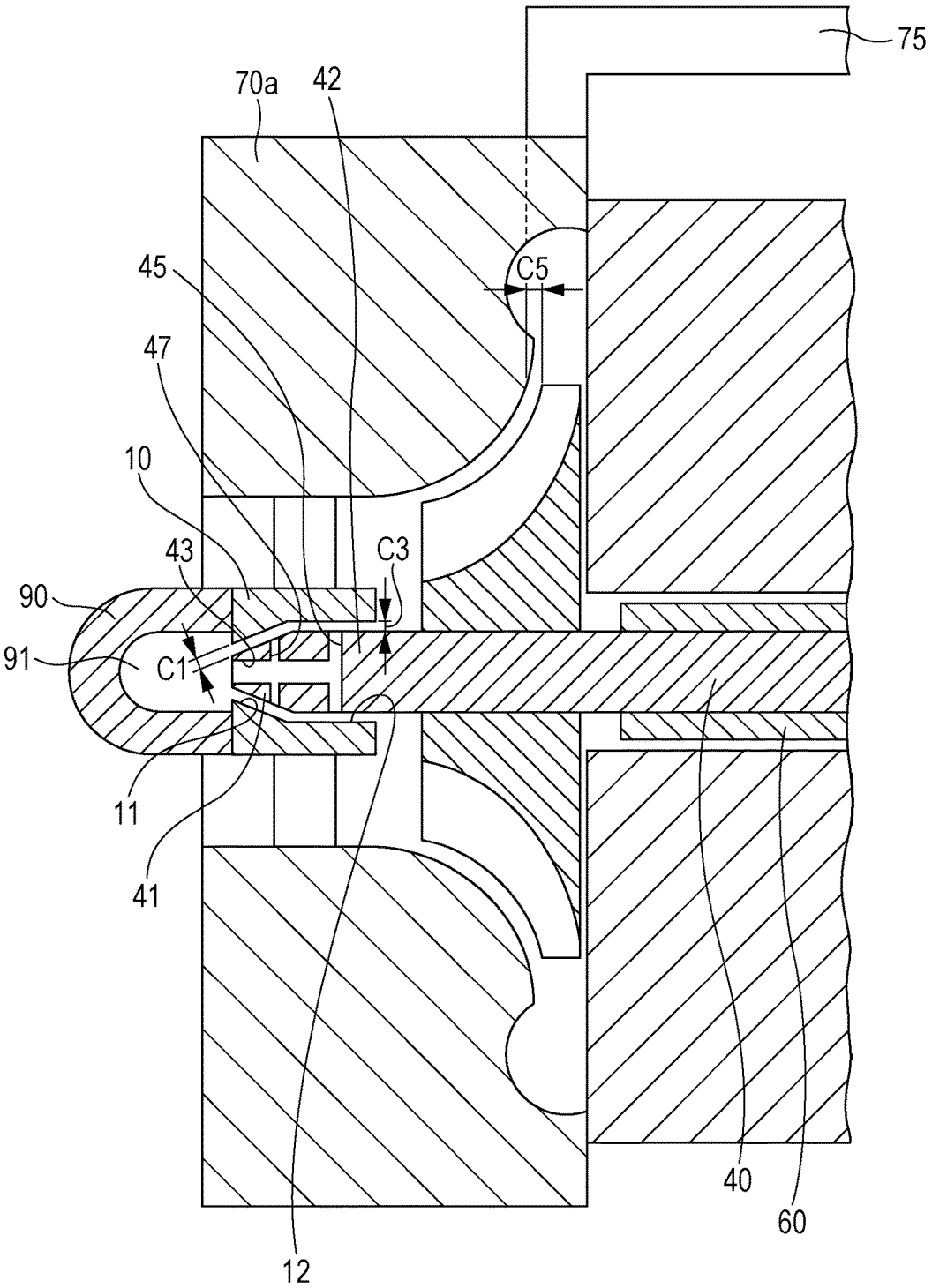
FIG. 6A is a partial enlarged sectional view of the turbo machine illustrated in FIG. 5.
Figure 6B:
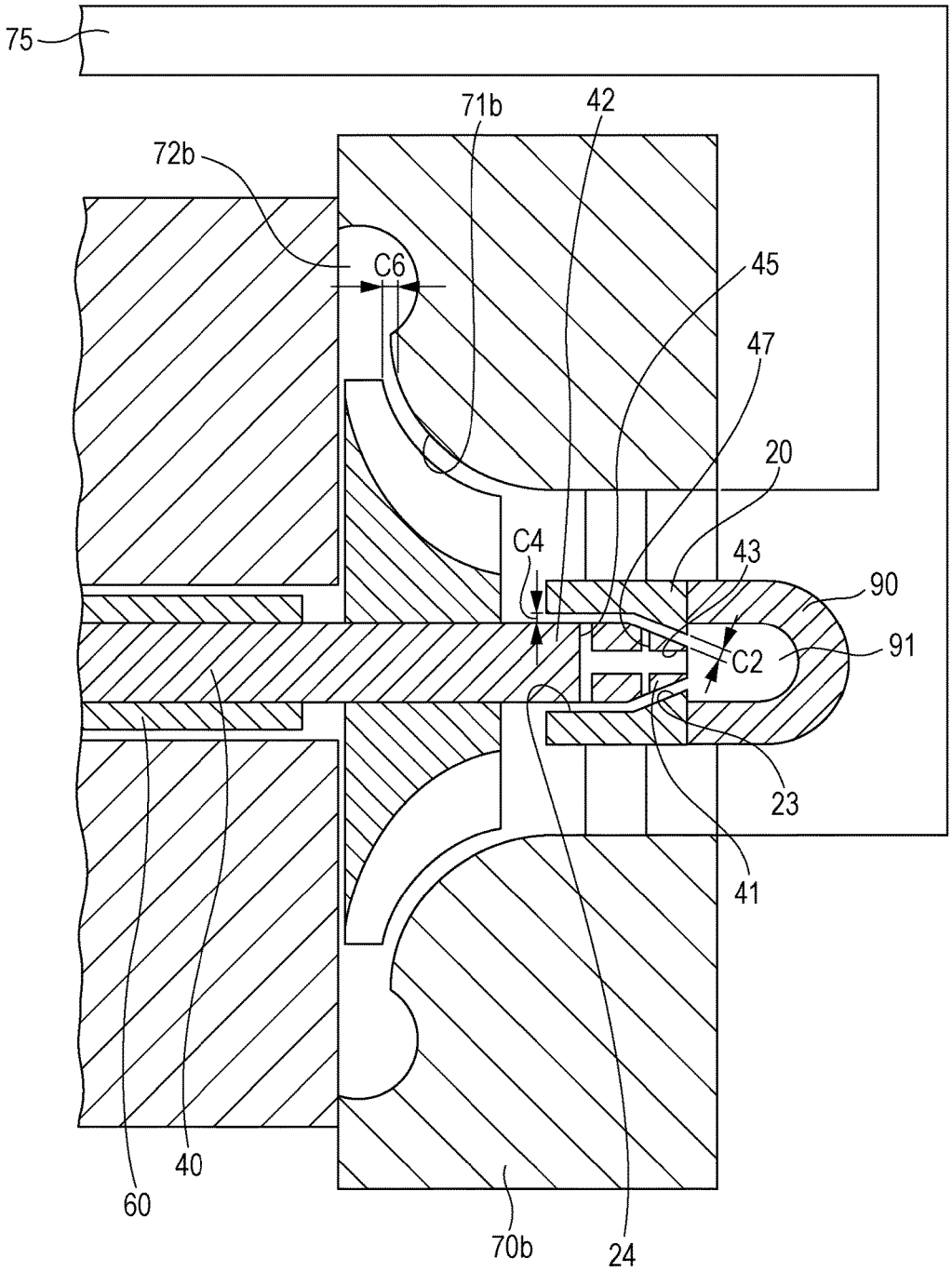
FIG. 6B is a partial enlarged sectional view of the turbo machine illustrated in FIG. 5.
Figure 7:
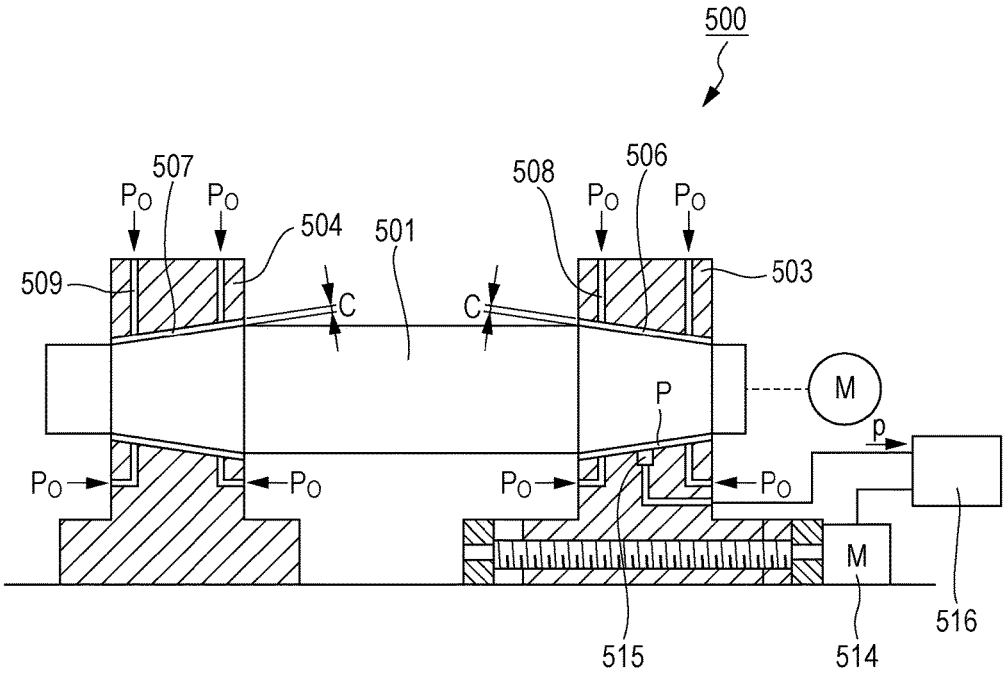
FIG. 7 is a sectional view of an existing air bearing device.

As illustrated in FIGS. 6A and 6B, the turbo machine 1*b* satisfies, for example, a formula C1+C2>C3+C4, wherein, C1 is the average clearance between the taper portion 41 (first taper portion) and the first bearing 10 in a direction perpendicular to an outer surface of the taper portion 41 (first taper portion), C2 is the average clearance between the taper portion 41 (second taper portion) and the second bearing 20 in the direction perpendicular to the outer surface of the taper portion 41 (second taper portion), C3 is the average clearance between the cylinder portion 42 (first cylinder portion) and the first bearing 10, and C4 is the average clearance between the cylinder portion 42 (second cylinder portion) and the second bearing 20. The average clearance C1 and the average clearance C3 are determined in the same way as in the first embodiment. The average clearance C2 is the average value of clearance around the rotation shaft 40 at an end of the taper bearing surface 23 in the axial direction of the rotation shaft 40, when it is assumed that the axis of the rotation shaft 40 coincides with the axis of the bearing hole of the second bearing 20. The average clearance C4 is the average value of clearance around the rotation shaft 40 at an end of the straight bearing surface 24 in the axial direction of the rotation shaft 40, when it is assumed that the axis of the rotation shaft 40 coincides with the axis of the bearing hole of the second bearing 20. The values of the average clearance C2 and the average clearance C4 are those at normal temperature.

When the turbo machine 1*b* satisfies the aforementioned formula, the clearance between the first bearing 10 or the second bearing 20 and the rotation shaft 40 in the axial direction of the rotation shaft 40 is larger than that in the radial direction of the rotation shaft 40. Therefore, even when the rotation shaft 40 thermally expands due to a rise in the temperature of the rotation shaft 40, a sufficient clearance can be provided between the first bearing 10 or the second bearing 20 and the rotation shaft 40. As a result, contact between the rotation shaft 40 and the first bearing 10 or the second bearing 20 can be prevented.

As illustrated in FIGS. 6A and 6B, the turbo machine 1*b* satisfies formulas C5>C1+C2 and C6>C1+C2, wherein, C5 is the minimum clearance between the inner surface of the first casing 70*a* and the first impeller 30*a* in the axial direction, and C6 is the minimum clearance between the inner surface of the second casing 70*b* and the second impeller 30*b* in the axial direction. The values of the minimum clearance C5 and the minimum clearance C6 are those at normal temperature. In this case, even if the rotation shaft 40 moves maximally in the axial direction or the rotation shaft 40 expands considerably in the axial direction, it is possible to prevent occurrence of a dangerous situation, such as breakage of a component due to contact between the first impeller 30*a* and the first casing 70*a* or contact between the second impeller 30*b* and the second casing 70*b*.

Preferably, the turbo machine 1*b* further satisfies formulas C5>C12 and C6>C12, wherein, C12 is the sum of the clearance between the taper portion 41 (first taper portion) and the first bearing 10 in the axial direction and the clearance between the taper portion 41 (second taper portion) and the second bearing 20 in the axial direction. In this case, contact between the first impeller 30*a* and the first casing 70*a* and contact between the second impeller 30*b* and the second casing 70*b* are more reliably prevented. The value of C12 is that at normal temperature.

Preferably, in the turbo machine 1*b*, the size of the first bearing 10 is the same as that of the second bearing 20, and the material of the first bearing 10 is the same as that of the second bearing 20. In this case, the first bearing 10 and the second bearing 20 expand to substantially the same degree when temperature changes. Therefore, a load with which the first bearing 10 supports the rotation shaft 40 and a load with which the second bearing 20 supports the rotation shaft 40 are unlikely to vary widely, so that the rotation shaft 40 can be stably held. Moreover, because the same components can be used for the first bearing 10 and the second bearing 20, the production costs of the turbo machine 1*b* can be reduced.

The turbo machine according to the present disclosure is particularly useful as a compressor of a refrigeration cycle device that is used in turbo freezers or commercial air conditioners.

What is claimed is:

1. A turbo machine comprising:

a rotation shaft that comprises a first taper portion and a first cylinder portion, the first taper portion decreasing in diameter toward one end of the rotation shaft, the first cylinder portion being constant in diameter in an axial direction of the rotation shaft;

a first impeller that is fixed to the rotation shaft and that is used for compressing or expanding working fluid;

a first bearing that rotatably supports the first taper portion and the first cylinder portion; and a second bearing that is positioned on an opposite side of the first impeller from the first bearing in the axial direction of the rotation shaft and that supports the rotation shaft both in the axial direction and a radial direction of the rotation shaft, wherein the rotation shaft further comprises:

a second taper portion that is located on the opposite side of the first impeller from the first bearing in the axial direction of the rotation shaft and that decreases in diameter toward the other end of the rotation shaft, and a second cylinder portion that is constant in diameter, a second bearing rotatably supports the second taper portion and the second cylinder portion on the opposite side of the first impeller from the first bearing, and the turbo machine satisfies a formula (B):

$$C1+C2>C3+C4 \quad \text{(B)},$$

wherein, C1 is an average clearance between the first taper portion and the first bearing in a direction perpendicular to an outer surface of the first taper portion, C2 is an average clearance between the second taper portion and the second bearing in a direction perpendicular to an outer surface of the second taper portion, C3 is an average clearance between the first cylinder portion and the first bearing in a direction perpendicular to an outer surface of the first cylinder portion, and C4 is an average clearance between the second cylinder portion and the second bearing in a direction perpendicular to an outer surface of the second cylinder portion.

2. The turbo machine according to claim 1, further comprising:

a motor that is disposed on the rotation shaft between the first bearing and the second bearing and that is used for rotating the rotation shaft; and a second impeller that is fixed to the rotation shaft, wherein with regard to the axial direction of the rotation shaft, the first bearing, the first impeller, the motor, the second impeller, and the second bearing are arranged in this order.

3. The turbo machine according to claim 2, further comprising:

a first casing that has an inner surface which is disposed around a low-pressure surface of the first impeller, and a second casing that has an inner surface which is disposed around a low-pressure surface of the second impeller, wherein the turbo machine satisfies formulas (C) and (D):

$$C5>C1+C2 \quad \text{(C)}$$

$$C6>C1+C3 \quad \text{(D)}$$

wherein, C5 is a minimum clearance between the inner surface of the first casing and the first impeller in the axial direction, C6 is a minimum clearance between the inner surface of the second casing and the second impeller in the axial direction.

4. The turbo machine according to claim 1, wherein the rotation shaft further comprises:

a first main lubricant supply hole that extends from an inlet located at the one end of the rotation shaft in the axial direction of the rotation shaft; and a first backward sub lubricant supply hole that diverges from the first main lubricant supply hole and that extends to a first backward outlet in the radial direction of the rotation shaft, the first backward outlet being open to a space that is located between the first cylinder portion and the first bearing.

5. The turbo machine according to claim 4, wherein the first backward sub lubricant supply hole has a diameter which is smaller than that of the first main lubricant supply hole.

6. The turbo machine according to claim 4, further comprising:

a first lubricant case that is connected to the first bearing and that has a space for storing lubricant which is supplied to the first bearing.

7. The turbo machine according to claim 1, wherein the rotation shaft further comprises:

a first main lubricant supply hole that extends from an inlet located at the one end of the rotation shaft in the axial direction of the rotation shaft; and a first forward sub lubricant supply hole that diverges from the first main lubricant supply hole and that extends to a first forward outlet in the radial direction of the rotation shaft, the first forward outlet being open to a space that is located between the first taper portion and the first bearing.

8. The turbo machine according to claim 1, wherein the rotation shaft further comprises:

a first main lubricant supply hole that extends from an inlet located at the one end of the rotation shaft in the axial direction of the rotation shaft;

a first backward sub lubricant supply hole that diverges from the first main lubricant supply hole and that extends to a first backward outlet in the radial direction of the rotation shaft, the first backward outlet being open to a space that is located between the first cylinder portion and the first bearing; and a first forward sub lubricant supply hole that diverges from the first main lubricant supply hole and that extends to a first forward outlet in the radial direction of the rotation shaft, the first forward outlet being open to a space that is located between the first taper portion and the first bearing.

9. The turbo machine according to claim 1, wherein the working fluid is used as lubricant that is supplied to the first bearing or the second bearing.

10. The turbo machine according to claim 1, wherein the size of the first bearing is the same as that of the second bearing, and the material of the first bearing is the same as that of the second bearing.

11. The turbo machine according to claim 1, wherein the working fluid has a negative saturated vapor pressure at a temperature in a range of 20° C.±15° C., inclusive.

* * * * *